US006553679B2

(12) United States Patent
Todd

(10) Patent No.: US 6,553,679 B2
(45) Date of Patent: Apr. 29, 2003

(54) ALIGNMENT TOOL FOR CLIP ANGLES

(76) Inventor: Duane L. Todd, 219 Navajo Trail, Buffalo Grove, IL (US) 60089

( * ) Notice: Subject to any disclaimer, the term of this patent is extended or adjusted under 35 U.S.C. 154(b) by 0 days.

(21) Appl. No.: 09/872,019

(22) Filed: Jun. 1, 2001

(65) Prior Publication Data

US 2002/0178597 A1 Dec. 5, 2002

(51) Int. Cl.[7] ..... G01B 5/14
(52) U.S. Cl. ..... 33/484; 33/474
(58) Field of Search ..... 33/484, 42, 427, 33/430, 443, 485, 486, 474

(56) References Cited

U.S. PATENT DOCUMENTS 365,031 A * 6/1887 Traut ..... 33/27.031
496,748 A * 5/1893 Saum ..... 33/486
3,168,783 A * 2/1965 Morehead ..... 33/42
4,353,169 A * 10/1982 Mitchell ..... 33/173
4,512,081 A * 4/1985 Park ..... 33/27.03
5,430,947 A * 7/1995 Courtney ..... 33/484
5,546,671 A * 8/1996 Kehoe ..... 33/648

* cited by examiner

*Primary Examiner*—Diego Gutierrez
*Assistant Examiner*—Tania C. Courson
(74) *Attorney, Agent, or Firm*—Goldstein & Lavas, P.C.

(57) ABSTRACT

An alignment tool for clip angles including an attachment portion adapted for being coupled with a square and a hole of a clip angle. The attachment portion should be perfectly alignment with the hole of the clip angle to define a properly positioned hole.

4 Claims, 2 Drawing Sheets

ALIGNMENT TOOL FOR CLIP ANGLES

BACKGROUND OF THE INVENTION

The present invention relates to an alignment tool for clip angles and more particularly pertains to speeding up the installation of clip angles in structural steel.

The use of fastener devices is known in the prior art. More specifically, fastener devices heretofore devised and utilized for the purpose of joining items are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,904,023 to diGirolamo discloses a clip for connecting metal studs in the construction of a wall. U.S. Pat. No. 4,800,698 to Murphy discloses a clip for joining sheet metal beams.

While these devices fulfill their respective, particular objective and requirements, the aforementioned patents do not describe an alignment tool for clip angles for speeding up the installation of clip angles in structural steel.

In this respect, the alignment tool for clip angles according to the present invention substantially departs from the conventional concepts and designs of the prior art, and in doing so provides an apparatus primarily developed for the purpose of speeding up the installation of clip angles in structural steel.

Therefore, it can be appreciated that there exists a continuing need for a new and improved alignment tool for clip angles which can be used for speeding up the installation of clip angles in structural steel. In this regard, the present invention substantially fulfills this need.

SUMMARY OF THE INVENTION

In the view of the foregoing disadvantages inherent in the known types of fastener devices now present in the prior art, the present invention provides an improved alignment tool for clip angles. As such, the general purpose of the present invention, which will be described subsequently in greater detail, is to provide a new and improved alignment tool for clip angles which has all the advantages of the prior art and none of the disadvantages.

To attain this, the present invention essentially comprises an attachment portion adapted for being coupled with a square and a hole of a clip angle. The attachment portion includes a cylindrical member having a first end and a second end. The first end is dimensioned for being slidably received within the hole of the clip angle. The attachment portion includes elongated upper and lower plates extending outwardly from the second end of the cylindrical member. The upper and lower plates have a space disposed therebetween for receiving the square therein. The upper and lower plates each have free outer ends. The upper and lower plates each have a pair of aligned apertures therethrough inwardly of the outer free ends thereof for selectively receiving a nut and bolt arrangement for securing the attachment portion to the square. The upper plate has an alignment window formed therein. The alignment window includes a back end with a central measurement slot formed therein. The central measurement slot should be perfectly alignment with the hole of the clip angle to define a properly positioned hole.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved alignment tool for clip angles which has all the advantages of the prior art fastener devices and none of the disadvantages.

It is another object of the present invention to provide a new and improved alignment tool for clip angles which may be easily and efficiently manufactured and marketed.

It is a further object of the present invention to provide a new and improved alignment tool for clip angles which is of durable and reliable construction.

An even further object of the present invention is to provide a new and improved alignment tool for clip angles which is susceptible of a low cost of manufacture with regard to both materials and labor, and which accordingly is then susceptible of low prices of sale to the consuming public, thereby making such an alignment tool for clip angles economically available to the buying public.

Even still another object of the present invention is to provide a new and improved alignment tool for clip angles for speeding up the installation of clip angles in structural steel.

Lastly, it is an object of the present invention to provide a new and improved alignment tool for clip angles including an attachment portion adapted for being coupled with a square and a hole of a clip angle. The attachment portion should be perfectly alignment with the hole of the clip angle to define a properly positioned hole.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

Figure 1:
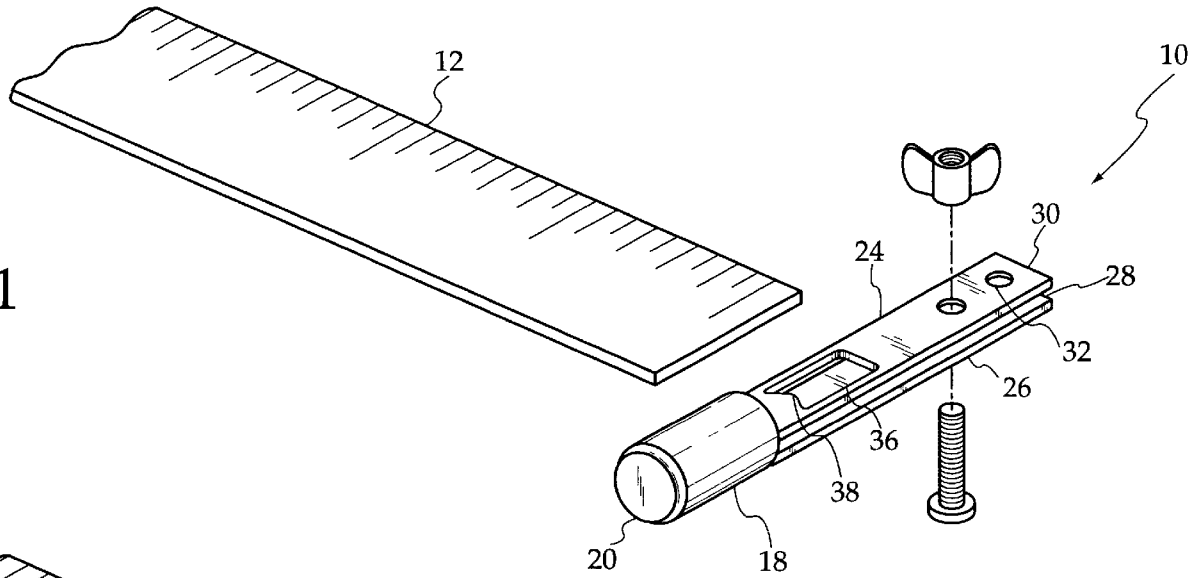
FIG. 1 is a perspective view of the preferred embodiment of the alignment tool for clip angles constructed in accordance with the principles of the present invention.
Figure 2:
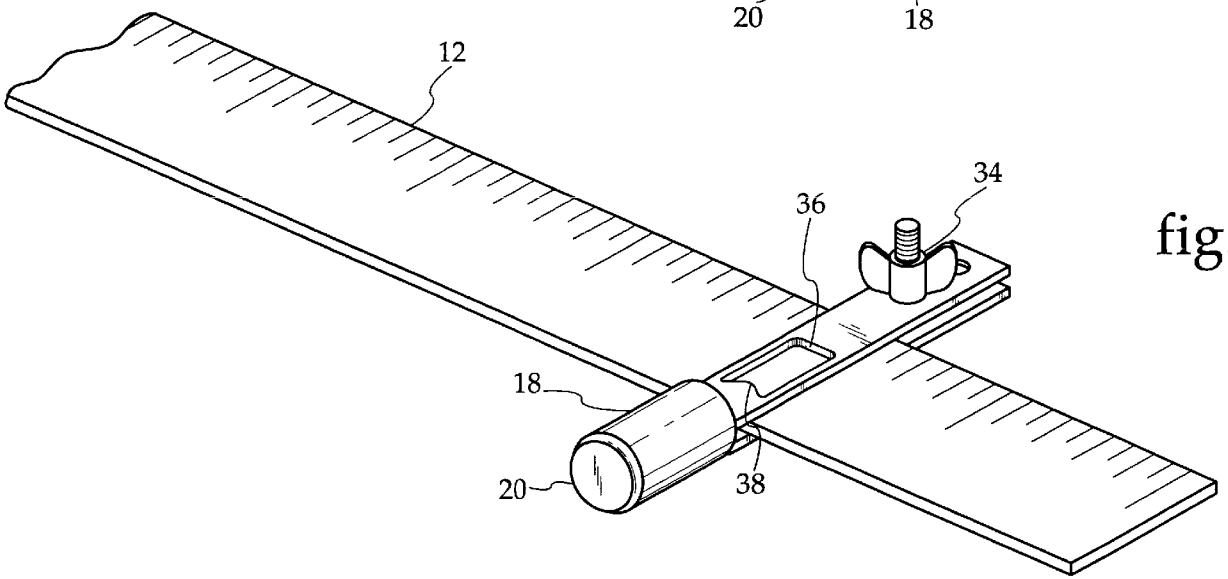
FIG. 2 is a perspective view of the present invention illustrated coupled with a square.
Figure 3:
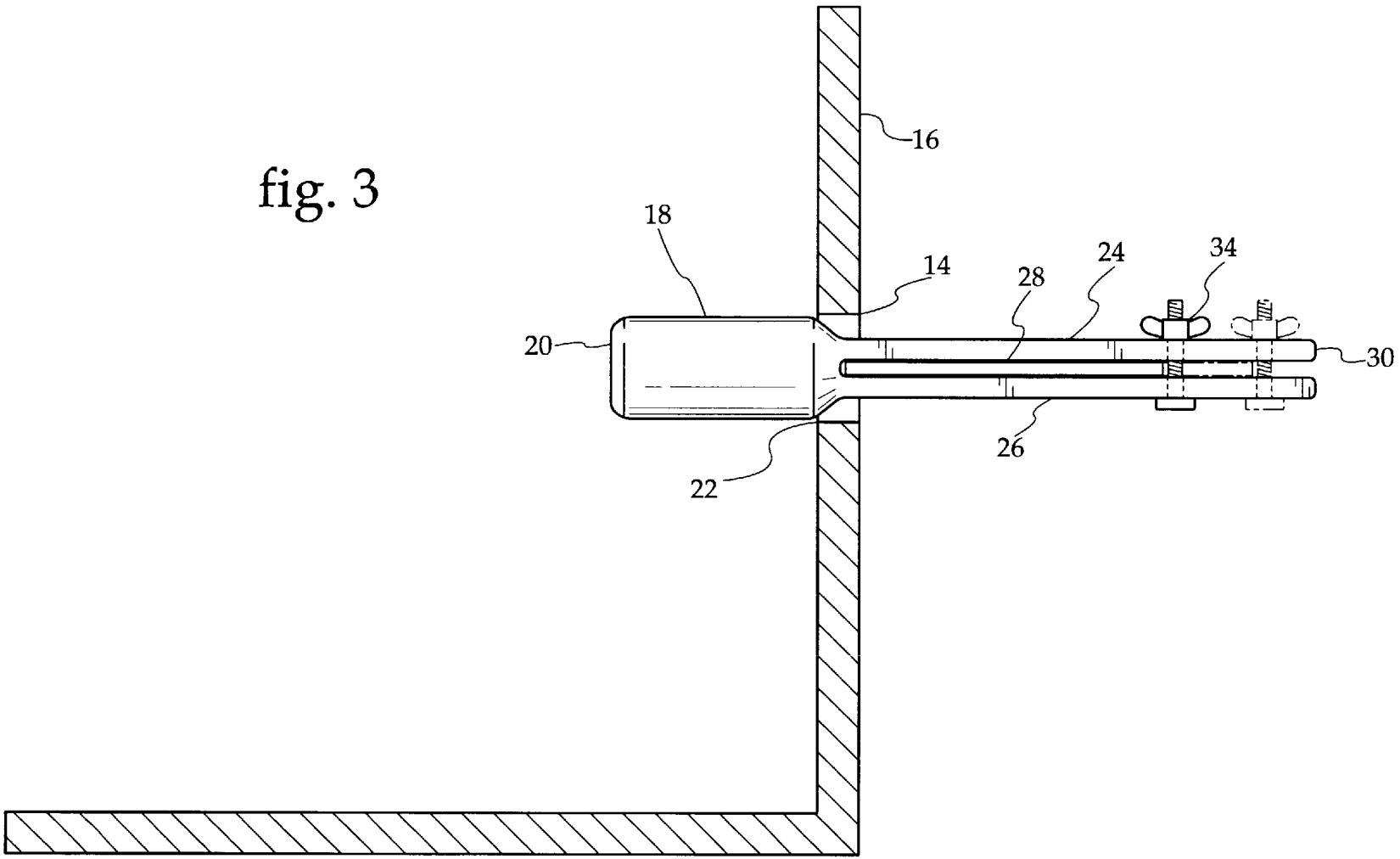
FIG. 3 is a side view of the present invention illustrated coupled with a clip angle.

With reference now to the drawings, and in particular, to figures one through three thereof, the preferred embodiment of the new and improved alignment tool for clip angles embodying the principles and concepts of the present invention and generally designated by the reference number 10 will be described.

Specifically, it will be noted in the various figures that the device relates to an alignment tool for clip angles for speeding up the installation of clip angles in structural steel.

The present invention is essentially comprised of an attachment portion 10. The attachment portion 10 is adapted for being coupled with a square 12 and a hole 14 of a clip angle 16. The attachment portion 10 includes a cylindrical member 18 having a first end 20 and a second end 22. The first end 20 is dimensioned for being slidably received within the hole 14 of the clip angle 16. The attachment portion 10 includes elongated upper and lower plates 24,26 extending outwardly from the second end 22 of the cylindrical member 18. The upper and lower plates 24,26 have a space 28 disposed therebetween for receiving the square 12 therein. The second end 22 tapers outwardly before merging with the upper and lower plates 24,26. The upper and lower plates 24,26 each have free outer ends 30. The upper and lower plates 24,26 each have a pair of aligned apertures 32 therethrough inwardly of the outer free ends 30 thereof for selectively receiving a nut and bolt arrangement 34 for securing the attachment portion 10 to the square 12. The upper plate 24 has an alignment window 36 formed therein. The alignment window 36 includes a back end with a central measurement slot 38 formed therein. The central measurement slot 38 should be perfectly aligned with the hole 14 of the clip angle 16 to define a properly positioned hole.

The present invention is a device that speeds up the installation of clip angles 16 in structural steel. The present invention can be secured to the square 12 so as to be inserted into the hole 14 in the clip angle 16 making sure the hole 14 is in alignment to the central measurement slot 38 and at the same time the clip angle 16 is square. The present invention will make sure that the hole's 16 on the clip angles 16 are properly aligned and positioned.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An alignment tool for clip angles for speeding up the installation of clip angles in structural steel comprising, in combination:

an attachment portion coupled with a square and a hole of a clip angle, the attachment portion including a cylindrical member having a first end and a second end, the first end being dimensioned for being slidably received within the hole of the clip angle, the attachment portion including elongated upper and lower plates extending outwardly from the second end of the cylindrical member, the upper and lower plates having a space disposed therebetween for receiving the square therein, the upper and lower plates each having free outer ends, the upper and lower plates each having a pair of aligned apertures therethrough inwardly of the outer free ends thereof for selectively receiving a nut and bolt arrangement for securing the attachment portion to the square, the upper plate having an alignment window formed therein, the alignment window including a back end with a central measurement slot formed therein, whereby the central measurement slot should be perfectly alignment with the hole of the clip angle to define a properly positioned hole.

2. An alignment tool for clip angles for speeding up the installation of clip angles in structural steel comprising, in combination:

an attachment portion coupled with a square and a hole of a clip angle to ensure a properly positioned hole, wherein the attachment portion includes a cylindrical member having a first and second end, the first end being dimensioned for being slidably received within the hole of the clip angle and elongated upper and lower plates extending outwardly from the second end of the cylindrical member, the upper and lower plates having a space disposed therebetween for receiving the square therein, and wherein the upper and lower plates each have free outer ends.

3. The alignment tool for clip angles as set forth in claim 2, wherein the upper and lower plates each having a pair of aligned apertures therethrough inwardly of the outer free ends thereof for selectively receiving a nut and bolt arrangement for securing the attachment portion to the square.

4. The alignment tool for clip angles as set forth in claim 3, wherein the upper plate has an alignment window formed therein, the alignment window including a back end with a central measurement slot formed therein, whereby the central measurement slot should be perfectly aligned with the hole of the clip angle to define the properly positioned hole.

* * * * *